US009010718B2

(12) United States Patent
Foote

(10) Patent No.: US 9,010,718 B2
(45) Date of Patent: Apr. 21, 2015

(54) SEAL ASSEMBLY FOR A PRESSURE PLATE IN A BLOWOUT PREVENTER

(76) Inventor: Dean Foote, Edmonton (CA)

( * ) Notice: Subject to any disclaimer, the term of this patent is extended or adjusted under 35 U.S.C. 154(b) by 586 days.

(21) Appl. No.: 12/854,068

(22) Filed: Aug. 10, 2010

(65) Prior Publication Data

US 2011/0031700 A1 Feb. 10, 2011

Related U.S. Application Data

(60) Provisional application No. 61/232,655, filed on Aug. 10, 2009.

(51) Int. Cl.
*E21B 33/06* (2006.01)

(52) U.S. Cl.
CPC ..... *E21B 33/06* (2013.01)

(58) Field of Classification Search
USPC ..... 251/1.1, 1.2, 1.3; 277/324, 327, 637, 277/641, 642, 647, 644, 643, 640
See application file for complete search history.

(56) References Cited

U.S. PATENT DOCUMENTS

| | | | | |
|---|---|---|---|---|
| 1,709,949 | A | 4/1929 | Rasmussen | |
| 2,467,061 | A * | 4/1949 | Mason | 220/327 |
| 3,663,025 | A * | 5/1972 | Nadherny et al. | 277/637 |
| 4,638,972 | A | 1/1987 | Jones | |
| 5,044,602 | A | 9/1991 | Heinonen | |
| 5,433,454 | A * | 7/1995 | Ramberg | 277/643 |
| 5,575,451 | A * | 11/1996 | Colvin et al. | 251/1.3 |
| 5,579,718 | A * | 12/1996 | Freerks | 118/733 |
| 5,897,094 | A * | 4/1999 | Brugman et al. | 251/1.3 |
| 6,089,543 | A * | 7/2000 | Freerks | 251/357 |
| 6,305,695 | B1 * | 10/2001 | Wilson | 277/584 |
| 6,629,682 | B2 * | 10/2003 | Duelli | 251/158 |
| 6,695,357 | B2 * | 2/2004 | Schenk et al. | 285/355 |
| 6,932,354 | B2 * | 8/2005 | Kane et al. | 277/608 |
| 7,029,013 | B2 * | 4/2006 | Yajima et al. | 277/637 |
| 7,104,545 | B2 * | 9/2006 | Williams et al. | 277/637 |
| 7,854,434 | B2 * | 12/2010 | Heiman et al. | 277/644 |
| 2002/0121746 | A1 * | 9/2002 | Albrecht | 277/637 |
| 2004/0104540 | A1 * | 6/2004 | Foote et al. | 277/637 |
| 2006/0097461 | A1 * | 5/2006 | Tsuji et al. | 277/637 |
| 2006/0208430 | A1 * | 9/2006 | Malz et al. | 277/637 |
| 2009/0256317 | A1 * | 10/2009 | Mellander | 277/642 |

FOREIGN PATENT DOCUMENTS

| | | |
|---|---|---|
| CA | 2 506 828 C | 7/2009 |

* cited by examiner

*Primary Examiner* — John K Fristoe, Jr.
*Assistant Examiner* — Andrew J Rost
(74) *Attorney, Agent, or Firm* — Christensen O'Connor Johnson Kindness PLLC

(57) ABSTRACT

A seal assembly for sealing a pressure plate against an opening in a blowout preventer body has a seal groove formed in the pressure plate and a seal in the seal groove. The seal groove has a first groove portion adjacent to a sealing face of the blowout preventer, and a second groove portion extending past the sealing face into the opening of the blowout preventer body. The seal has a first seal portion in the first groove portion and a second seal portion in the second groove portion.

6 Claims, 6 Drawing Sheets

10

SEAL ASSEMBLY FOR A PRESSURE PLATE IN A BLOWOUT PREVENTER

FIELD

This relates to a seal for a pressure plate in a blowout preventer.

BACKGROUND

Referring to FIGS. 1 and 2, a blowout preventer 10 has a body 12, rams 14 that carry ram blocks 16, and an internal cavity 18 that is closed by a pressure plate 20. The pressure plate 20 is removable to allow access to the interior cavity 18 to service the blowout preventer 10, replace the ram blocks 16, etc. The depicted blowout preventer 10 is a "double gate", although other designs, such as a single, triple, etc. gate design could also be used.

Referring to FIG. 3, the pressure plate 20 carries block guides 22 and is installed against a sealing area 24 on body 12 that surrounds the interior cavity 18 shown in FIG. 1. Referring to FIG. 4 through 6, the typical method to seal the pressure plate 20 is to provide an "o"-ring face seal 26 about each of the openings of the cavity 18. The "o"-rings 26 are contained in specifically sized grooves 28 that are machined into the pressure plate 20. The groove 28 is sized such that the seal 26 protrudes out of the face of the groove 28, as shown in FIG. 4. When the pressure plate 20 is installed, the "o"-rings 26 are compressed against the face of the body 12 and squeezed into the groove 28, as shown in FIG. 5. Referring to FIG. 4 through 6, the "o"-ring takes the general shape of the groove 28, but does not fill the entire volume and leaves spaces 30, particularly in the corners of the rectangular groove 28, as can be seen in FIG. 5. This compression of the "o"-ring seal 26 into the groove 28 initiates the seal to contain well bore fluids. When the internal pressure increases, the well fluids act against the "o"-rings 26 to maintain the seal. The well fluid pressure acts directly on the "o"-ring 26 to further compress it into the remaining spaces of the rectangular groove, as shown in FIG. 6. This seal system allows pressurized well fluid to act directly against the "o"-ring 26 and fill the groove 28. This action causes "wetting" of the groove 28 and face of the body 12 up to the "point of seal" against the "o"-ring 26.

SUMMARY

There is provided a seal assembly for sealing a pressure plate against an opening in a blowout preventer body, comprising a seal groove formed in the pressure plate and a seal. The seal groove has a first groove portion adjacent to a sealing face of the blowout preventer, and a second groove portion extending past the sealing face into the opening of the blowout preventer body. The seal has a first seal portion in the first groove portion and a second seal portion in the second groove portion.

According to another aspect, the first seal portion may be integrally formed with the second seal portion, or may be separate and distinct from the second seal portion.

According to another aspect, the seal groove may be defined by a plate secured within a recess in the pressure plate. The second seal portion may comprises a slotted seal positioned on an outer circumferential edge of the plate.

According to another aspect, the second seal portion may be extruded into the opening of the blowout preventer body when the pressure plate is installed on the blowout preventer body.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

As discussed above, the prior art seal system causes "wetting" of the groove 28 and face of the body 12 up to the "point of seal" against the "o"-ring 26. This action can often result in corrosion and pitting of the wetted steel surfaces because of the nature of the well bore fluids, particularly if salts are present. When the damage is severe, both the pressure plate 20 and face of the body 12 must be repaired to ensure they will seal properly, generally using an expensive weld and machining procedure. The process often "warps" the pressure plate 20 because the welding is confined to the groove side. When put back into use and bolted, further damage can occur from the nuts torqued against the warped outside surface. Repeated repairs also cause material degradation due to the repeated thermal cycles of welding and stress relieving.

Figure 1:
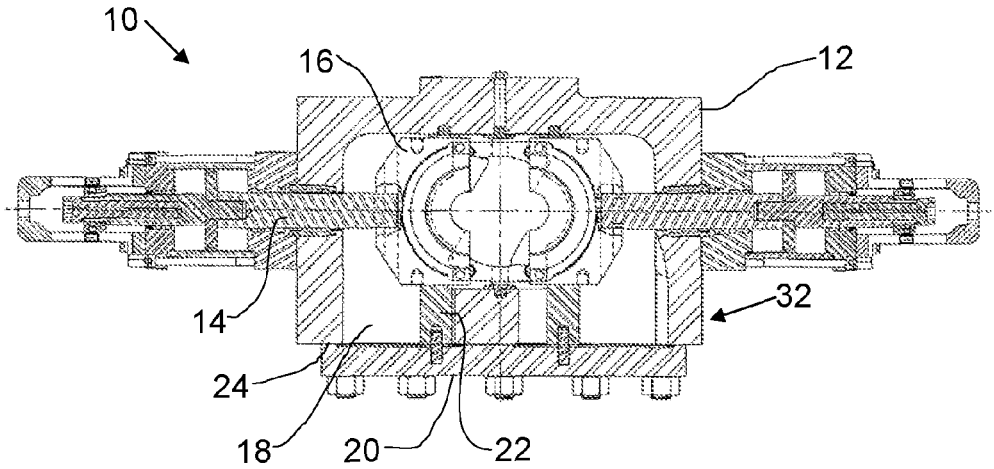
FIG. 1 is a top plan view in section of a blowout preventer with a seal assembly.
Figure 2:
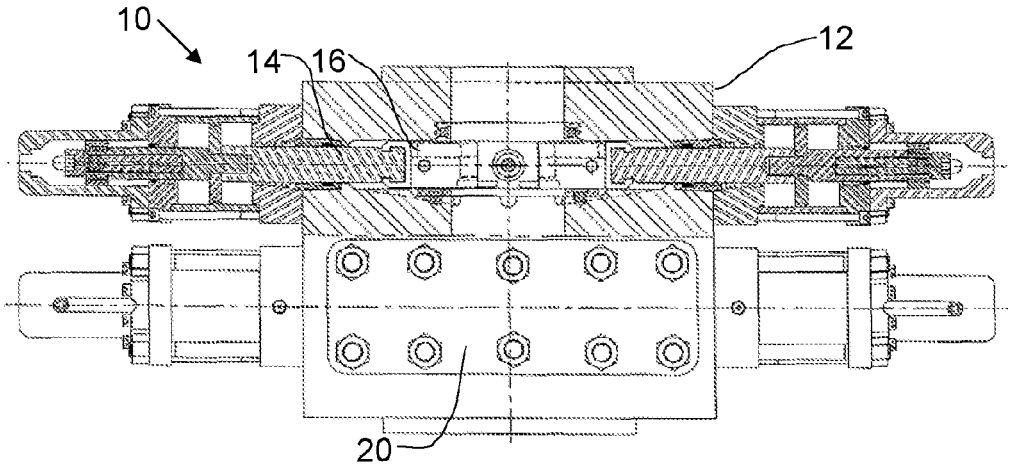
FIG. 2 is a side elevation view in partial section of a blowout preventer with a seal assembly.
Figure 3:
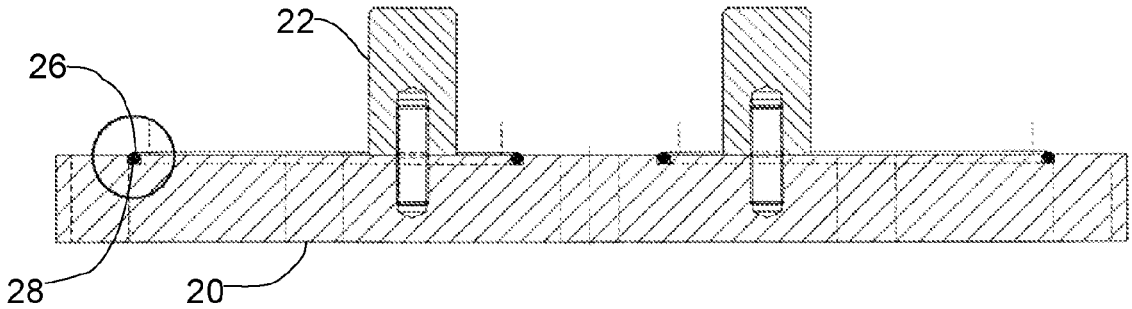
FIG. 3 PRIOR ART
FIG. 3 is a side elevation view in section of a prior art pressure plate.
Figure 4:
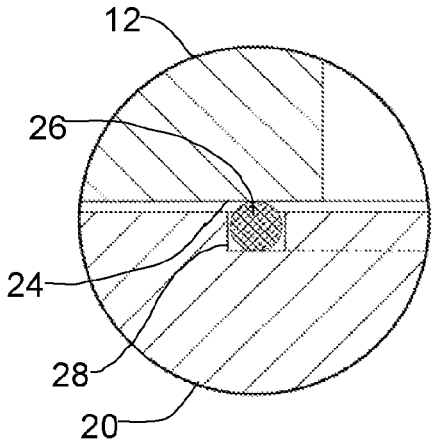
FIG. 4 PRIOR ART
FIG. 4 through 6 are detailed side elevation views in section of a prior art seal as it is installed between the pressure plate and the blowout preventer body.
Figure 5:
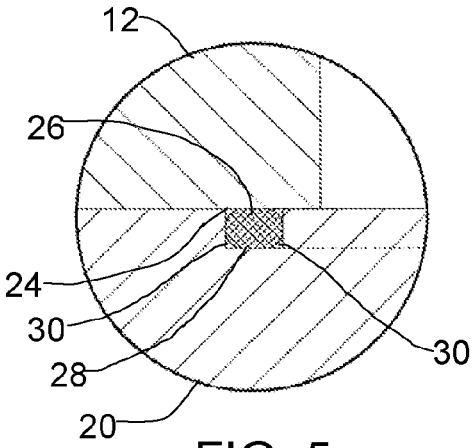
FIG. 5 PRIOR ART
Figure 6:
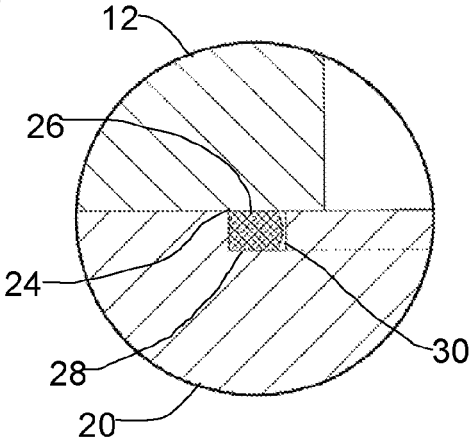
FIG. 6 PRIOR ART
Figure 7:
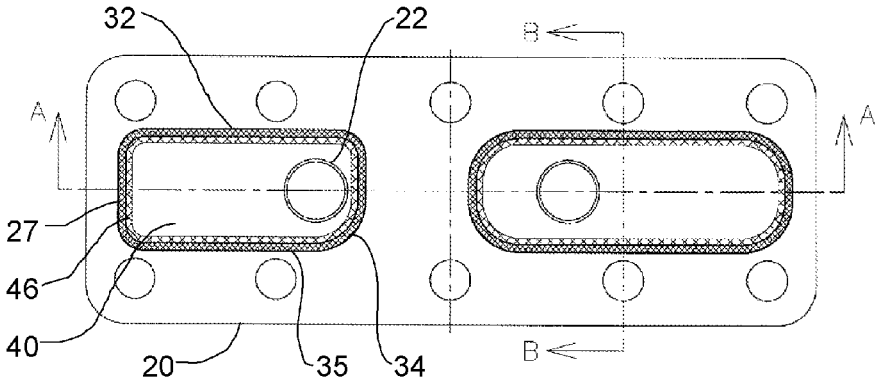
FIG. 7 is a top plan view of a pressure plate with the seal assembly.
Figure 8:
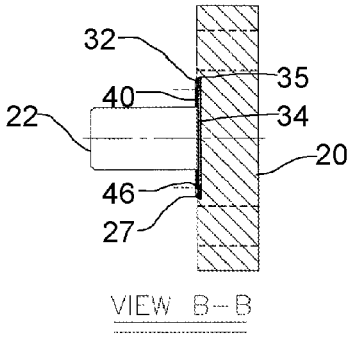
FIG. 8 is an end elevation view in section of the pressure plate along line B-B in FIG. 7.
Figure 9:
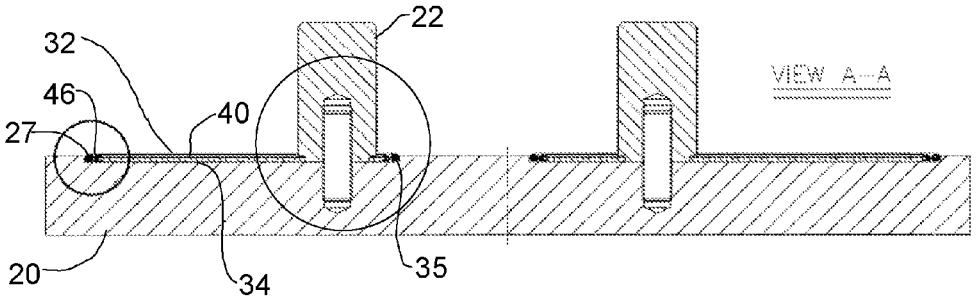
FIG. 9 is a side elevation view in section of the pressure plate along line A-A in FIG. 7.

Referring to FIG. 7 through 9, the depicted pressure plate 20 is designed to cover two cavity openings as can be seen in FIG. 1, which are different in both shape and size for this particular blowout preventer. The number, size and shape may be made to match any opening to be sealed. The seal assembly 32 carried by the pressure plate 20 is designed to protect both the body face and the pressure plate from corrosive well fluids and reduce repair frequency. This is accomplished by denying well fluids access to the normally wetted surfaces in other designs described above.

Figure 10:
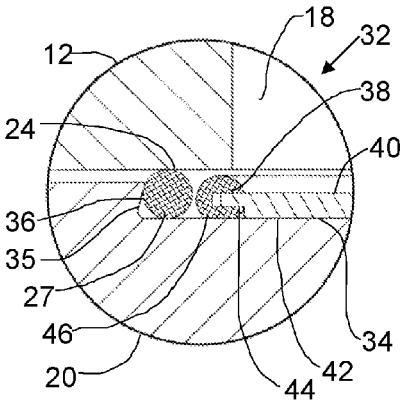
FIG. 10 through 12 are a detailed side elevation views in section of the seal assembly as it is installed between the pressure plate and the blowout preventer body.
Figure 14:
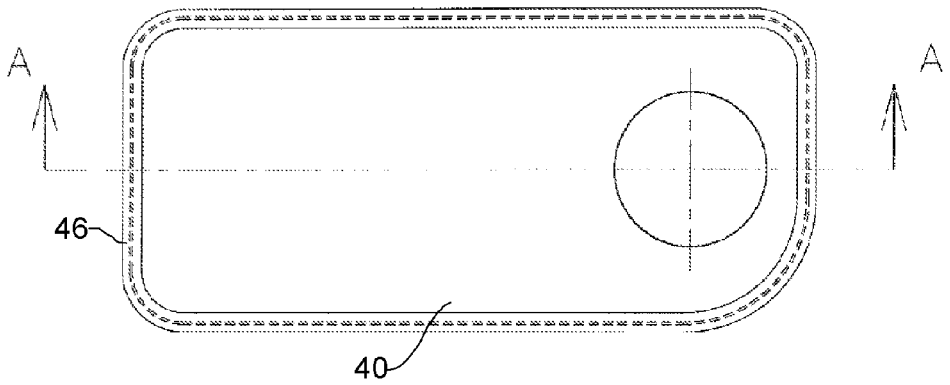
FIG. 14 is a top plan view of a plate.
Figure 15:
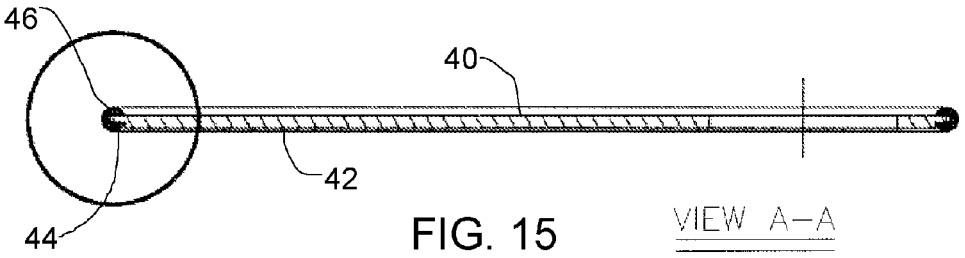
FIG. 15 is a side elevation view in section of the plate along line A-A in FIG. 14.
Figure 16:
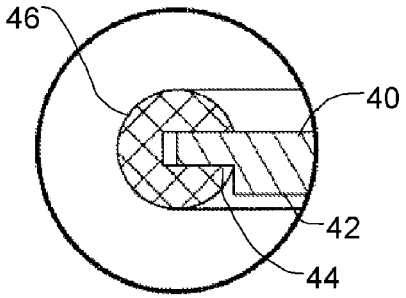
FIG. 16 is a detailed side elevation view in section of the slotted seal installed on the edge of the plate.

Referring to FIG. 7 through 9, each opening to be sealed is matched by an appropriately shaped, recessed profile 34 in the pressure plate 20, which forms the groove 35. Referring to FIG. 10, the outside edge 36 of the recess 34, which forms the outside containment for the "o"-ring 27, is preferably angled slightly to help hold the face seal "o"-ring 27 in place for assembly. In the depicted embodiment, the inside edge 38 of the groove 35 to contain the "o"-ring 27 consists of two parts. Referring to FIG. 14 through 16, the first part is an appropriately shaped plate 40. For superior corrosion protection, stainless steel or chemically resistant composite are preferred choices of materials for this part. The plate 40 is contoured appropriately to match the opening to be sealed. Around the perimeter of the bottom side 42 of the plate is a notch 44 machined to receive a slotted "o"-ring 46. "O"-ring 27 and slotted "o"-ring 46 may be considered a two-part seal between pressure plate 20 and blowout preventer body 12 in a groove defined by recessed profile 34 and plate 40. A slotted "o"-ring design has been chosen for material availability and economic reasons. Other means may be employed, such as specifically shaped extruded profiles, cut to length and "joined" together, or integral moulded parts. These will be discussed in more detail below. The slotted "o"-ring 46 is sized to be "snug" around the profiled plate 40 without inducing too much stretching stress to cause failure. The slotted "o"-ring 46 may optionally be secured in place with a specific adhesive about the notch area.

Figure 11:
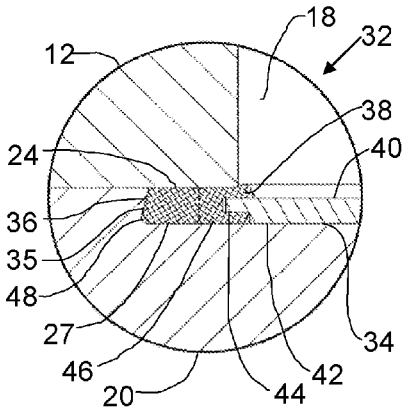
Figure 12:
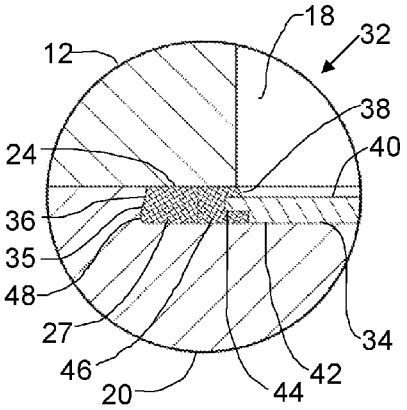
Figure 13:
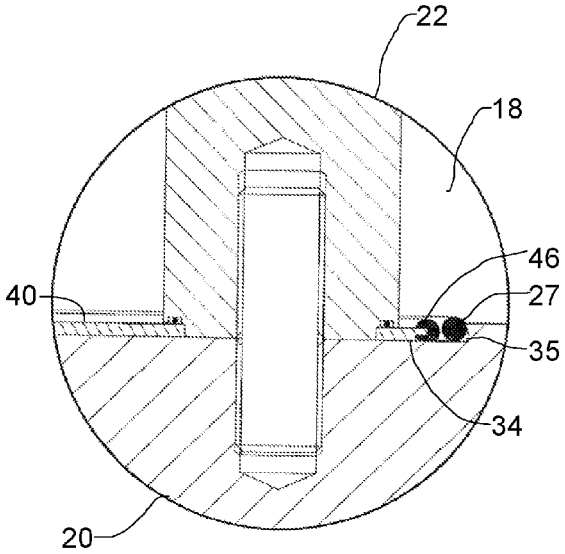
FIG. 13 is a detailed side elevation view in section of the block guide attached to the pressure plate.

Referring to FIG. 11, the combination of the plate 40 and the slotted "o"-ring 46 is sized to meet the opening with some of the slotted "o"-ring 46 protruding into the opening of the cavity 18 it is sealing. Referring to FIG. 9, the plate 40 and slotted "o"-ring 46 assembly may be secured to the pressure plate 20 with a stud and block guide 22. These are common parts used in a blowout preventer of this type and are convenient to use to secure the plate 40 and slotted "o"-ring 46 assembly into the recess 34 if it is sealed appropriately as shown in FIG. 13. Once the plate 40 and slotted "o"-ring 46 assembly secured to the pressure plate 12, the face seal "o"-ring 27 may be inserted into the resulting groove 35, as shown in FIG. 10. Referring to FIGS. 10 and 11, when the pressure plate 12 is installed on the body 12, the face seal "o"-ring 27 and slotted "o"-ring 46 are "squeezed" between the recess 34 and the seal surface of the body 12. FIG. 11 displays an approximate representation of the installed pressure plate 12. It is important to note that the face seal "o"-ring 27 has sufficient space for compression during installation to prevent damage. This is evident by the "voids" 48, or unfilled spaces in the groove area 35 that rubber from the face seal "o"-ring 27 has not filled. If an "o"-ring is not left sufficient space for compression, it can "bulge" out into the space between the mating steel surfaces and be damaged. This type of assembly problem is avoided by designing and positioning the slotted "o"-ring seal 46 such that excess slotted "o"-ring material "flows" out into the cavity 18, as shown in FIG. 11. Referring to FIG. 12, when the well bore pressure increases, it acts upon the excess slotted "o"-ring material in the cavity 18 and forces it against the face seal "o"-ring 27 as the "voids" are filled within the seal system. In this manner, the face seal "o"-ring 27 conforms to its' confined space to maintain a seal by pressure applied to it from the slotted "o"-ring 46, rather than pressure applied directly from corrosive well bore fluids. The plate 40 that houses the slotted "o"-ring 46, sealed in place by the block guide 22, protects the remainder of the recess in the pressure plate 20. By denying the well bore fluids access to the face seal "o"-ring surfaces of the body 12 and the entire pressure plate 20, corrosion of these critical seal areas is prevented. Repairs are greatly reduced and reliability substantially increased. As depicted, the groove 35 has two portions—one that is adjacent to the sealing surface 24 and another that extends into the inner cavity 18. These portions may be distinct, or may be more generally defined, where the portion is defined by the function of the portion of the seal that is contained in that area. It will also be understood that the portion that extends into the inner cavity 18 is preferably also partially in contact with the sealing surface 24 of the body 12.

Figure 17:
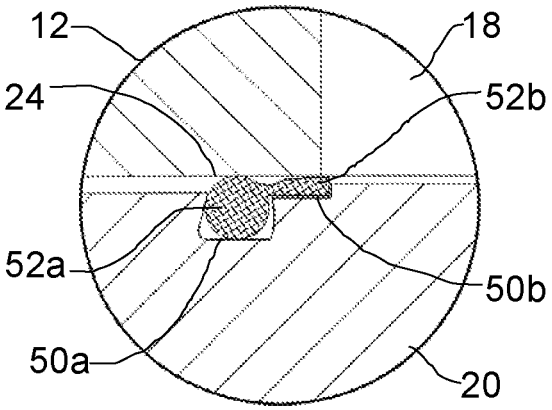
FIGS. 17 and 18 are detailed side elevation views of alternate seal assemblies for sealing between the pressure plate and the blowout preventer body.
Figure 18:
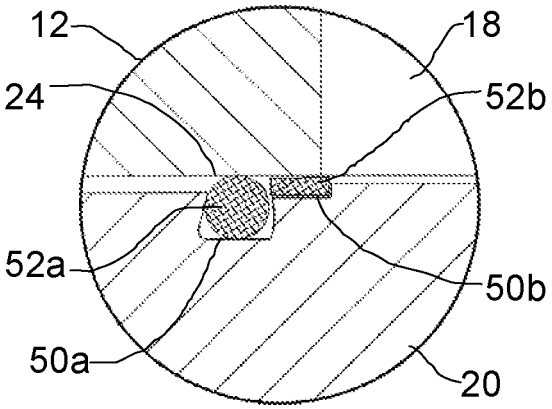

Referring to FIGS. 17 and 18, it will be understood that other designs may also be used. In these examples, a seal groove 50 in pressure plate 20 that extends into the opening 18 to be sealed, as with the example discussed previously. Seal groove 50 has a first portion **50*a* that is adjacent to the sealing area 24, and a second portion 50*b* that extends out from under the sealing area 24 into the opening 18. It will be noted that, in these examples, a plate 40 is not used to form the seal groove. A two-part seal 52, which may or may not be integrally formed, is positioned within the seal groove 50, such that it is compressed within the seal groove 50 when the pressure plate 20 is attached, and the pressure from the wellbore fluids is applied to the exposed portion of the seal 52. A first portion 52*a* is positioned in the first portion 50*a* of the seal groove 50 to seal against the body 12, while the second portion 52*b* is positioned in the second portion 50*b* of the seal groove, where it will extrude into the opening 18 when the pressure plate 20 is installed, and be exposed to the pressure of the wellbore fluids. While the portion of the pressure plate 20 that is within the inner cavity 18 is shown to be raised relative to the rest, it may also be sufficient to form a seal-retaining surface into the pressure plate 20 without a raised portion. The inner surface of groove 50*a* is preferably curved to help retain seal 52. In FIG. 17, the seal 52 is a single component, such as may be formed from an extruded piece of elastic material that is cut to the desired length and vulcanized In FIG. 18, an "o"-ring 54 is used with a gasket 56. In these embodiments, the exposed surfaces, such as the central portion of the pressure plate 20**, are preferably coated in a rust-inhibiting surface, such as by electroplating.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A seal assembly for sealing pressure plate against an opening in a blowout preventer body, the seal assembly comprising:

a seal groove formed in the pressure plate and recessed from a face of the pressure plate that engages the blowout preventer body, the seal groove having a first groove portion adjacent to a sealing face of the blowout preventer, and a second groove portion adjacent to and extending past the sealing face into the opening of the blowout preventer body, the opening being defined by an inner edge of the sealing face; and a seal having a first seal portion in the first groove portion and a second seal portion in the second groove portion, the second seal portion engaging the sealing face and the inner edge of the sealing face such that the second seal portion seals against the seal face and such that a portion of the second seal portion extends into the opening.

2. The seal assembly of claim 1, wherein the first seal portion is integrally formed with the second seal portion.

3. The seal assembly of claim 1, wherein the first seal portion is separate and distinct from the second seal portion and wherein the first seal portion is in contact with the second seal portion.

4. The seal assembly of claim 1, wherein the second seal portion is extruded into the opening of the blowout preventer body when the pressure plate is installed on the blowout preventer body.

5. A seal assembly for sealing a pressure plate against an opening in a blowout preventer body, the seal assembly comprising:

a seal groove formed in the pressure plate and recessed from a face of the pressure plate that engages the blowout preventer body, the seal groove having a first groove portion adjacent to a sealing face of the blowout preventer, and a second groove portion adjacent to and extending past the sealing face into the opening of the blowout preventer body, the opening being defined by an inner edge of the sealing face, the seal groove being defined by a plate secured within a recess in the pressure plate; and a seal having a first seal portion in the first groove portion and a second seal portion in the second groove portion, the second seal portion engaging the sealing face and the inner edge of the sealing face such that the second seal portion seals against the seal face and such that a portion of the second seal s portion extends into the opening.

6. The seal assembly of claim 5, wherein the second seal portion comprises a slotted seal positioned on an outer circumferential edge of the plate.

* * * * *